United States Patent [19]

Yokoyama

[11] Patent Number: 4,664,179

[45] Date of Patent: May 12, 1987

[54] HEAT EXCHANGER

[75] Inventor: Seishi Yokoyama, Togitsu, Japan

[73] Assignee: Mitsubishi Denki Kabushiki Kaisha, Tokyo, Japan

[21] Appl. No.: 716,229

[22] Filed: Mar. 26, 1985

[30] Foreign Application Priority Data

Jun. 23, 1984 [JP] Japan ..... 59-94275[U]

[51] Int. Cl.[4] ..... F28F 7/00

[52] U.S. Cl. ..... 165/76; 165/125

[58] Field of Search ..... 165/125, 76

[56] References Cited

U.S. PATENT DOCUMENTS

| | | | |
|---|---|---|---|
| 2,153,120 | 4/1934 | Ludlow et al. | 165/125 X |
| 2,260,594 | 10/1941 | Young | 165/125 |
| 2,261,579 | 11/1941 | Booth | 165/125 X |
| 2,311,947 | 2/1943 | Kucher | 165/125 X |
| 2,526,243 | 10/1950 | Lange | 165/125 |
| 2,773,364 | 12/1956 | Zipser | 165/125 X |
| 3,759,321 | 9/1973 | Ares | 165/125 |
| 4,202,409 | 5/1980 | Cann et al. | 165/125 X |
| 4,307,778 | 12/1981 | Tobin et al. | 165/125 |
| 4,380,263 | 4/1983 | Wright | 165/125 X |
| 4,465,125 | 8/1984 | Haas | 165/125 X |

OTHER PUBLICATIONS

A brochure entitled: Hitachi Packaged Air Conditioners.

A PAH brochure.

*Primary Examiner*—Albert W. Davis, Jr.

*Assistant Examiner*—Peggy A. Neils

*Attorney, Agent, or Firm*—Oblon, Fisher, Spivak, McClelland & Maier

[57] ABSTRACT

A heat exchanging apparatus of a construction having a heat exchanger unit which is constructed with heat exchanging plate fins or similar types of fins and heat transfer tubes orthogonally intersecting with the heat exchanging fins, wherein the improvement is such that the heat exchanger unit is formed in a semi-circular cylindrical shape, and that mutually opposed closure plates, each having a semi-circular contour, are tightly fixed at both end parts of the fins of the heat exchanger unit in a detachably attachable manner by means of supporting rods for fastening the closure plates together.

4 Claims, 14 Drawing Figures

HEAT EXCHANGER

BACKGROUND OF THE INVENTION

This invention relates to a heat exchanger to be used for a refrigerating apparatus.

As the above-mentioned sort of heat exchanger, there has so far been known such one as shown in FIGS. 1 to 3.

The heat exchanging apparatus shown in these figures of drawing is of such a construction that a pair of heat exchangers 1, each being in a planar shape and made up of plates fins and heat transfer tubes orthogonally intersecting with the plate fins, are fixedly secured on an under-frame 3 and disposed in such a manner that an air blower 2 may be interposed between these two planar heat exchangers, and that both sides of the mutually opposed heat exchangers 1, 1 are closed by side plates 4, 5 to form a casing. The air blower 2 is fixed on a structure which projects upwardly of the under-frame 3. the top plate 6 for the casing is so provided that it may block flow of air in the casing together with the side plates 4, 5, thereby constructing the floor-setting type heat exchanging apparatus with good installing property. Further, a power source tap 7 is incorporated in an electrical circit of a refrigerating apparatus, and connecting tubes 8, 8 are joined with refrigerant circulating tubes in a refrigerant circuit shown in FIG. 4.

FIG. 4 is a schematic diagram showing a coolant circulating system of the refrigerating apparatus, in which the above-described heat exchanger is used. It should be noted that, in FIG. 4, the same component parts as those in FIG. 1 to 3 are designated by the same reference numerals. Besides these common constituent parts, a reference numeral 9 designates a refrigerant compressor, a numeral 10 refers to a water-side heat exchanger, a reference numeral 11 represents an expansion valve, 12 a gas-side four-way valve, 13 a liquid-side four-way valve, 14 an accumulator, and 15 is a refrigerant distributing tube, to which the connecting tubes of the heat exhanging apparatus is connected.

The refrigerant circuit shown in FIG. 4 is used in a case where the heat exchanger is to be operated as an evaporator, hence the following explanations will be made as to the use of the heat exchanger in such case. The refrigerating gas which has been compressed in the refrigerant compressor 9 is rendered a high temperature and high pressure gas, and flows into the water-side heat exchanger 10 through the gas-side four-way valve 12. In this heat exchanger 10, the refrigerating gas carries out heat-exchange with water to become condensed, i.e., it is turned into a high pressure refrigerant liquid. The high pressure refrigerant liquid passes through the liquid-side four-way valve 13 and is reduced its pressure by the expansion valve 11 to be turned into a low pressure refrigerant liquid, after which it flows into the heat exchanger 1 to perform the evaporating function. By the way, since the heat exchanger 1 is frosted by the evaporating function during the winter season, water draining takes place at the time of defrosting, and, during the intermediate seasons such as spring and autumn, no frosting occurs but dew condensation takes place on the heat exchanger, which also brings about draining of water.

The conventional heat exchanging apparatus of the above-described construction as shown in FIGS. 1 to 3 has various problems such that it requires a large number of component parts including a pair of heat exchangers and two side plates for the casing, and sufficient heat-exchanging space at both sides of the heat exchangers, and, more over, there are many restrictions imposed on its installation, by which the heat exchanging apparatus is limited to the floor-setting type, all these leading to the increase in cost for manufacture and installation of the heat exchanging apparatus.

SUMMARY OF THE INVENTION

The object of the present invention is to solve these problems inherent in the conventional heat exchanging apparatus as described in the foregoing, and to provide a heat exchanging apparatus of a simple construction with less number of component parts, of a low manufacturing cost, and with less restriction to be imposed on its setting. Such heat exchanging apparatus can be realized by forming the heat exchanger in a semi-cylindrical shape, and fixing, at both end parts of the fins of the heat exchanger unit, mutually opposed closure plates having a semi-circular contour in a detachably attachable manner by means of supporting rods which fasten together these opposing pair of closure plates.

BRIEF DESCRIPTION OF THE DRAWINGS

One way of carrying out the invention is described in detail hereinbelow with reference to the accompanying drawings which illustrate only one specific embodiment thereof, in which.

DETAILED DESCRIPTION OF THE PREFERRED EMBODIMENTS

Figure 2:
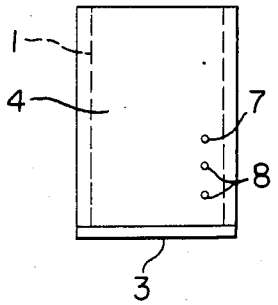
FIGURE 2 PRIOR ART
FIG. 2 is a side elevational view of the same.

In the following, a single preferred embodiment of the present invention will be explained in detail in reference to FIGS. 5 through 12 inclusive.

Referring to these figures of drawing, the heat exchanger 16 in a semi-cylindrical configuration is constructed with heat-exchanging fins 17, each being made of an oblong plate, heat transfer tubes 18 (having inlets and outlets extending outside of the heat exchanger) for the heat exchanger which intersect orthogonally with these plate fins 17, and metal fittings 19, 20 for fixing the heat exchanging apparatus in position, which extend outwardly of both sides of the heat exchanger 16. Reference numerals 22 and 23 designate closure plates of a semi-circular contour. The closure plate 22 is of such a construction that a side plate 22*b* is provided around a surface plate 22*a* with an opening 22*c* having been formed in one part thereof to be adapted to receive the air blower 21 into it, in such a manner that the side plates may be projected inwardly along the direction of the axis of the air blower. The closure plate 23 is of such a construction that a side plate 23*b* is provided around a surface plate 23*a* having no opening therein and being slightly inclined from the semi-circular edge thereof toward the center part of its diametrical edge so that the center part thereof may be at the outwardly protruded position, in such a manner that the side plates may be projected inwardly along the direction of the axis of the air blower. Tapered drain pipes 24 and 25 are so provided that they may jut outwardly of the surface plates 22*a* and 23*a* of the closure plates 22 and 23, respectively, in the axial direction of the air blower.

The heat exchanger 16 is directly engaged by stoppers 26 and 27 which project inwardly from the face plates 22*a* and 23*a* of the closure plates 22 and 23, respectively, along the direction of the axis of the air blower. Metal fittings 28 and 29 are provided in projection from the semi-circular outer peripheral surface of the side plates 22*b* and 23*b* of the respective closure plates 22 and 23. On the other hand, metal fittings 30 and 31 are projectively provided from the inner surface of straight portions of the side plates 22*b* and 23*b* of the respective closure plates 22 and 23. This permits the mounting arrangement shown in FIGS. 13 and 14. Bell-mouths 32 are formed around the opening 22*c* in the face plate 22*a* of the closure plate 22. Lugs 33 for fixing the air blower 21 are also provided on the face plate 22*a* of the closure plate 22 at the position outward of the bell-mouths 32 and in the same direction as that of the bell-mouths. Reference numeral 34 designate supporting rods for fastening the mutually opposing closure plates 22 and 23, each rod having screw-thread formed at both end parts thereof. A numeral 35 refers to nuts to be fitted with the screw-threaded parts of the supporting rods. A numeral 36 refers to caps to be placed on the drain pipes 24 and 25. By the way, it should be understood that the operating functions of the heat exchanging apparatus according to this embodiment are same as those of the conventional heat exchanging apparatus, hence any detailed explanations thereof will be dispensed with.

Figure 1:
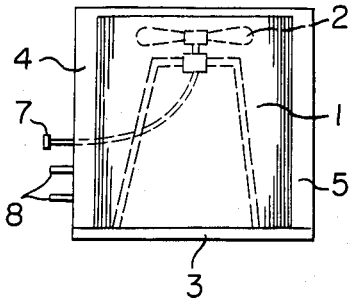
FIGURE 1 PRIOR ART
FIG. 1 is a front view showing a conventional heat exchanger.
Figure 3:
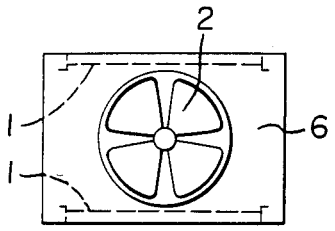
FIGURE 3 PRIOR ART
FIG. 3 is a top plan view of the same.
Figure 4:
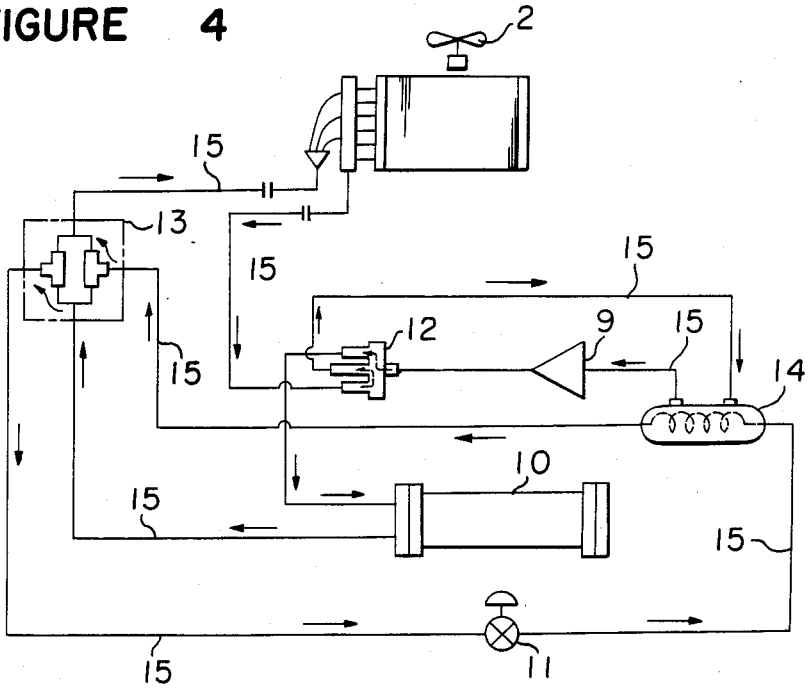
FIG. 4 is a refrigerant system diagram for explaining use of the heat exchanger.
Figure 6:
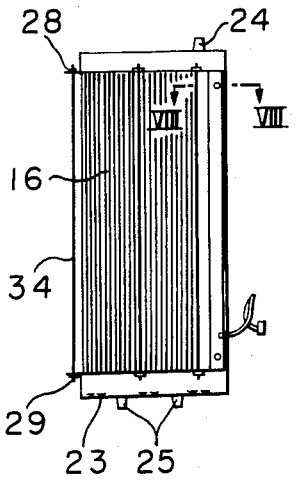
FIG. 6 is a side elevational view of the same.
Figure 5:
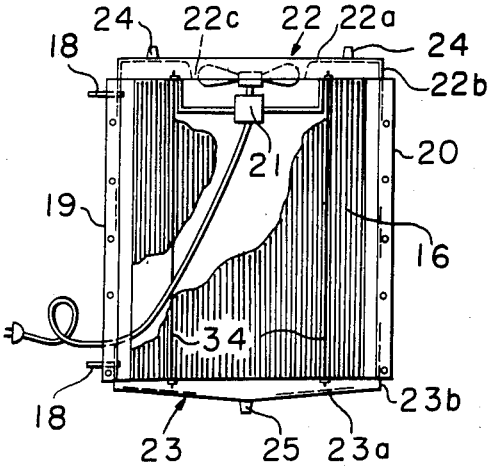
FIG. 5 is a front view of the heat exchanger according to one embodiment of the present invention.
Figure 8:
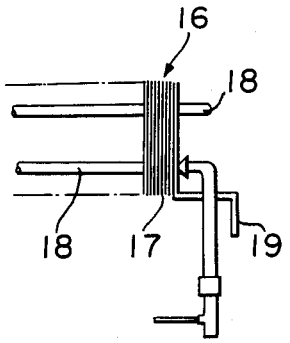
FIG. 8 is a cross-sectional view taken along a line VIII—VIII in FIG. 6.
Figure 7:
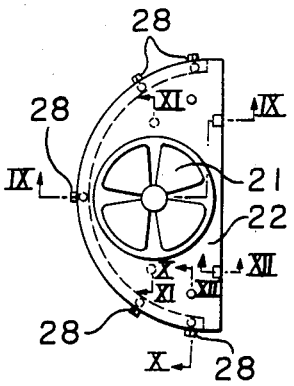
FIG. 7 is a top plan view of the same.
Figure 9:
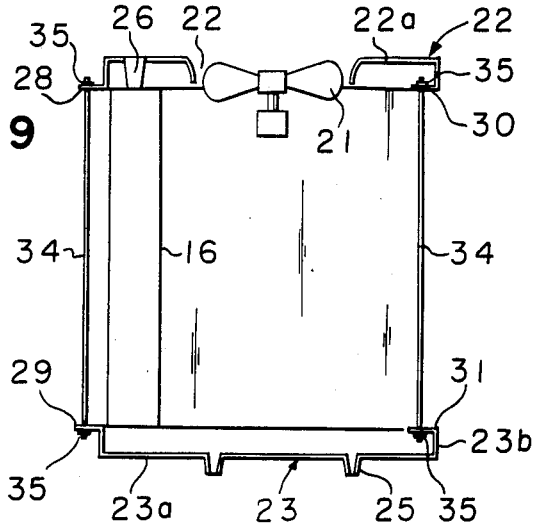
FIG. 9 is a cross-sectional view taken along a line IX—IX in FIG. 7.
Figure 10:
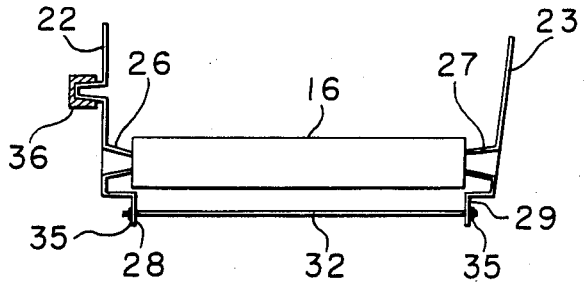
FIG. 10 is a cross-sectional view taken along a line X—X in FIG. 7.
Figure 12:
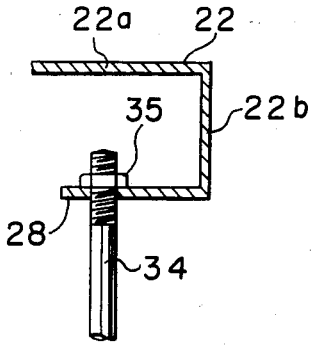
FIG. 12 is a cross-sectional view taken along a line XII—XII in FIG. 7.
Figure 11:
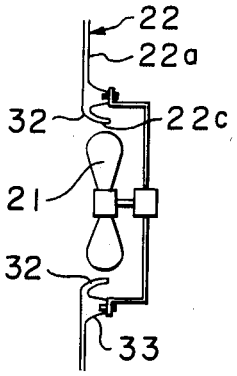
FIG. 11 is a cross-sectional view taken along a line XI—XI in FIG. 7.

In this embodiment of the heat exchanging apparatus according to the present invention, the simplified construction thereof is realized in the following manner: the closure plates 22 and 23 are fitted onto both external ends of the heat exchanger 16, then some of the supporting rods 34 are fittingly inserted into the metal fittings 28 and 29 and others into the metal fittings 30 and 31, and these supporting rods and the metal fittings are fastened together by means for detachably connecting and pressing including nuts 35 tightened on threads of the rods from outside of the metal fitting, thereby fixing the closure plates 22 and 23 in a detachably attachable manner; by clamping the heat exchanger 16 between the closure plates 22 and 23, rigidity is imparted to the heat exchanger 16 per se so as to make it unnecessary to provide the under-frame 3 which has heretofore been used (vide: FIG. 1); and the heat exchanger 16 is formed in a semi-circular configuration so as to open the rear side of the device to be the diametrical part of this semi-circular cylinder, thereby dispensing with the side plates 4 and 5 of the casing (vide: FIGS. 4 and 5). The above-mentioned air blower 21 is fixedly secured to the lugs 33 projectively provided on the closure plate 22. The surrounding portion of the opening 22*c* in the closure plate 22, which is made the air passage port, is protruded in the direction opposite to the air flow-out direction by the air blower 21 to thereby form the bell-mouths 32 which function to rectify the air flow, simultaneously adding to the bell-mouths 32 a function of reinforcement member, and further making it possible for the closure plate 22 to function as a drain receptacle when the heat exchanging apparatus is installed with the closure plate 22 being positioned downside. Moreover, by providing the drain pipes 24 in the closure plate 22, and the drain pipes 25 in the closure plate 23, it is made possible that the heat exchanging apparatus be useful, even when it is installed upside down. In case the heat exchanging apparatus is installed with the closure plate 22 facing topside, a drain cap 36 is fitted on each of the drain pipes 24 as shown in FIG. 10, while, when the heat exchanging apparatus is installed with the closure plate 23 facing topside, the drain cap 36 is fitted on each of the drain pipes 25. Incidentally, since the drain pipes 24 and 25 are formed in a tapered shape, and the drain cap 36 has also its corresponding tapered portion therein, either the drain pipes 24 or the drain pipes 25 can be readily closed by simply pounding or thrusting the drain cap on each drain pipe. The closure plate 22 has stoppers 26 which are projected therefrom in parallel with the direction of the axis of the air blower 21, the metal fittings 28 proejctively provided outwardly of the semi-circular peripheral surface with respect to the heat exchanger 16, and metal fittings 30 projected toward the side of the fitting surface of the air blower 21. In the same manner, the closure plate 23 is provided with stoppers 27, the metal fittings 29 and the metal fittings 31. As the result of making the closure plate in such a construction, the closure plates 22 and 23 can be fastened together by the supporting rods 34 and the nuts 35 in such a manner that the stopper 26 and the stopper 27 come into contact with the heat exchanging fins 17 and hold the heat exchanger 16 between them by the clamping force of the supporting rods and the nuts.

Figure 13:
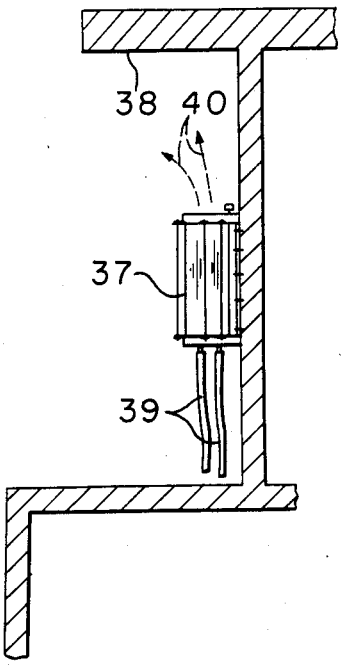
FIG. 13 and 14 are respectively side elevational views showing mutually different states of use of the heat exchanger according to a preferred embodiment of the present invention.
Figure 14:
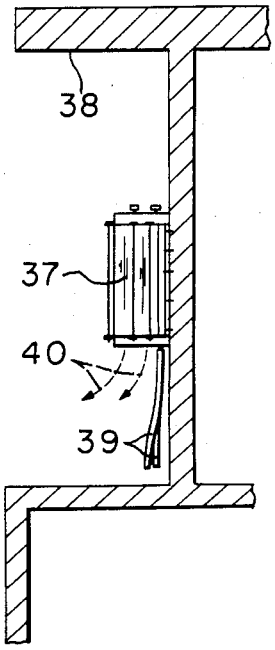

FIGS. 13 and 14 illustrate the states of setting the heat exchanging apparatus of the above-described construction. In these figures of the drawing, a reference numeral 37 designates the heat exchanging apparatus, a numeral 38 refers to a building, 39 a drain discharge pipe, and 40 air blown out of the heat exchanging apparatus 37. The heat exchanging apparatus 37, in this illustrated state of its use, is hung on the wall of the building 38 to thereby close the flat, rear open part of the heat exchanging apparatus 37. The heat exchanging apparatus 37, in this illustrated state of its use, is hung on the wall of the building 38 to thereby close the flat, rear open part of the heat exchanging apparatus 37. In FIG. 13, the heat exchanging apparatus is installed in such a fashion that the air 40 may be blown out from the top side, while, in FIG. 14, the heat exchanging apparatus is installed in such a fashion that the air 40 may be blown out from the bottom side thereof.

Incidentally, in the above-described embodiment of the heat exchanging apparatus according to the present invention, the heat exchanger 16, the closure plates 22, 23, and the air blower 21 are made to the principal component members to be assembed. It should, however, be noted that a still another closure plate may be provided on the flat, rear open part of the heat exchanging apparatus 37. Furthermore, in the above-described embodiment, explanations have been given as to the heat exchanging apparatus to be used for the refrigerating apparatus. It should, however, be noted that the heat exchanging apparatus may be for a water cooling device, or for other purposes. In addition, the fins for the heat exchanger are not limited to the plate fins, but any other types of fin may be equally used.

As has been explained in the foregoing, the heat exchanging apparatus according to the present invention is so constructed that the heat exchanger unit is formed in the semi-circular cylindrical shape, and the closure plates are fastened together by means of the supporting rods in a detachably attachable manner, so that there can be obtained remarkable effect such that the heat exchanging apparatus of lighter weight, lower cost of manufacture, and less restriction in its installation that those in the conventional heat exchanging apparatus can be provided, which is ascribable to the reduced number of component parts used for its construction.

I claim:

1. A heat exchanger apparatus comprising:

a plurality of elongated plate fins each having two ends, heat transfer tubes orthogonally intersecting said plate fins; said heat transfer tubes and fins being formed in a semi-circular cylindrical form;

two semi-circular closure plates, each of said closure plates being positioned adjacent one of said ends of said plate fins and having means for directly engaging said plate fins;

a plurality of supporting rods extending between said closure plates; and means for detachably connecting said rods to said closure plates and pressing said closure plate toward one another, whereby said means for directly engaging press against said ends of said plate fins;

wherein each of said closure plates has a circular portion corresponding to said semi-circular form, and a straight portion corresponding to a chord of said semicircular form, including first fittings fixed to said circular portion and extending radially outward therefrom and second fittings fixed to said stright portion and extending toward said curved portion, wherein said means for detachably connecting and pressing connect said support rods to said first and second fittings, whereby said apparatus may be mounted with said stright portions adjacent a flat wall.

2. The apparatus of claim 1 wherein said means for directly engaging comprise stoppers projecting from said closure plates.

3. The apparatus of claim 2 wherein said means for detachably connecting said pressing comprise nuts threaded on ends of said rods extending through holes in said closure plates.

4. A heat exchanging apparatus according to claim 1, wherein one of said closure plates is provided with lugs for fixing an air blower and bell-mouths for air flow, both being protruded in the same direction, and a plurality of drain pipes, each having a tapered end, are protruded in the direction opposite to said lugs.

* * * * *